US011053800B2

(12) United States Patent
Loisel et al.

(10) Patent No.: US 11,053,800 B2
(45) Date of Patent: Jul. 6, 2021

(54) TURBINE ROTOR DISK BLADE HAVING A FOOT OF CURVILINEAR SHAPE

(71) Applicant: SAFRAN AIRCRAFT ENGINES, Paris (FR)

(72) Inventors: Bruno Marc-Etienne Loisel, Moissy-Cramayel (FR); Carine Thuy-Huong Pragassam, Moissy-Cramayel (FR); Nicolas Marc Florent, Moissy-Cramayel (FR); Marion France Chambre, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 28 days.

(21) Appl. No.: 16/568,805

(22) Filed: Sep. 12, 2019

(65) Prior Publication Data

US 2020/0141243 A1 May 7, 2020

(30) Foreign Application Priority Data

Sep. 14, 2018 (FR) ..... 18 58324

(51) Int. Cl.
*F01D 5/12* (2006.01)
*F01D 5/30* (2006.01)

(52) U.S. Cl.
CPC ..... *F01D 5/12* (2013.01); *F01D 5/30* (2013.01); *F05D 2220/30* (2013.01)

(58) Field of Classification Search
CPC ..... F01D 5/12; F01D 5/30; F01D 5/14; F01D 5/3007; F05D 2250/71
See application file for complete search history.

(56) References Cited

U.S. PATENT DOCUMENTS 1,719,415 A * 7/1929 Back ..... F01D 5/3007 416/219 R
3,986,793 A * 10/1976 Warner ..... B23P 6/002 416/212 A (Continued)

FOREIGN PATENT DOCUMENTS

EP 1 138 879 A1 10/2001
EP 1 264 964 A1 12/2002
FR 2 471 502 A1 6/1981

(Continued)

OTHER PUBLICATIONS

French Preliminary Search Report dated May 23, 2019 in French Application18 58324, filed Sep. 14, 2018 (with English Translation of Categories of Cited Documents).

*Primary Examiner* — Eldon T Brockman
(74) *Attorney, Agent, or Firm* — Oblon, McClelland, Maier & Neustadt, L.L.P.

(57) ABSTRACT

A rotor blade for a rotor disk of a turbine of an aeronautical turbomachine includes, in a radial direction from inside to outside, a blade foot root, a support, a platform and a rotor vane, where the root is connected to the support by a neck. The neck has a curvilinear profile defining, in a section in a plane perpendicular to the radial direction, a curved shape. The neck section overlaps at least 75% of the section of the rotor vane, as a projection of the sections of the neck and of the rotor vane in a plane perpendicular to the radial direction, where the section of the rotor vane joins with the platform.

11 Claims, 3 Drawing Sheets

(56) References Cited

U.S. PATENT DOCUMENTS

| | | | | |
|---|---|---|---|---|
| 5,067,876 | A * | 11/1991 | Moreman, III | F01D 5/3007 416/219 R |
| 2007/0020102 | A1 | 1/2007 | Beeck et al. | |

FOREIGN PATENT DOCUMENTS

| | | | |
|---|---|---|---|
| FR | 3 045 709 | A1 | 6/2017 |
| JP | 07-310502 | A | 11/1995 |
| WO | WO 2010/074930 | A1 | 7/2010 |
| WO | WO 2014/020258 | A1 | 2/2014 |
| WO | WO 2017/209752 | A1 | 12/2017 |

* cited by examiner

TURBINE ROTOR DISK BLADE HAVING A FOOT OF CURVILINEAR SHAPE

TECHNICAL FIELD

The present invention relates to the general field of turbo machines, and more specifically to the field of turbine rotor blades for aeronautical turbo machines, and more specifically turbine rotor disks fitted with such blades, such as, for example, the disks described in patent application EP 1 264 964 A1.

The invention applies to all types of land-based or aeronautical turbo machines, and in particular to aircraft turbo machines, such as turbojets and turboprop engines.

STATE OF THE PRIOR ART

Figure 1:
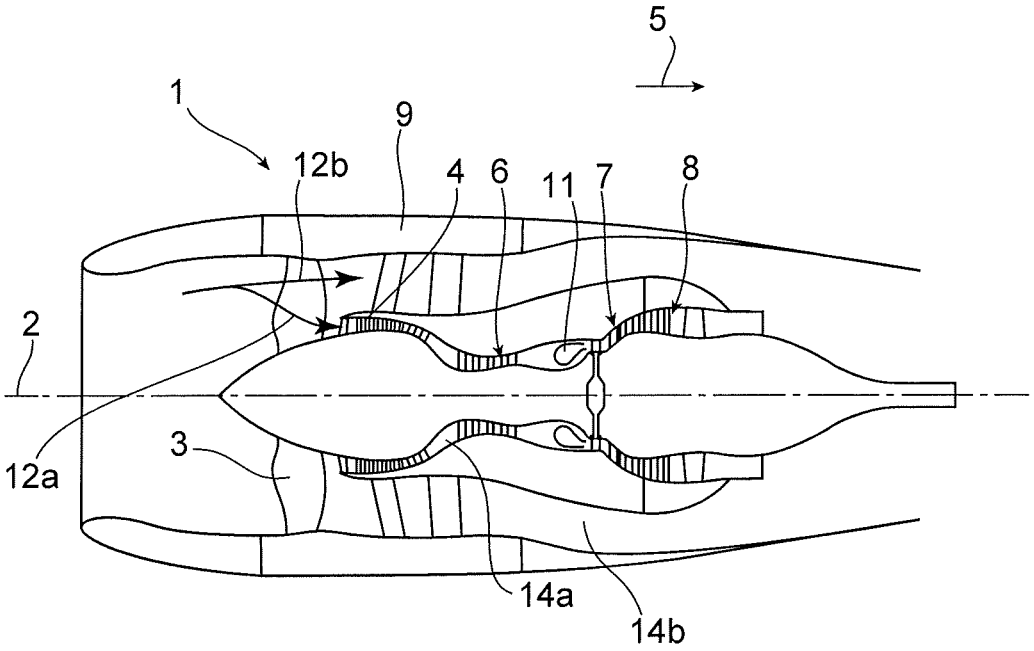

FIG. 1 represents an aeronautical turbomachine 1, for example in this case a twin-body turbofan, which has a longitudinal central axis 2 around which its various components extend. It includes, from upstream to downstream in a main outflow direction 5 of the gases through this turbomachine, a fan 3, a low-pressure compressor 4, a high-pressure compressor 6, a combustion chamber 11, a high-pressure turbine 7 and a low-pressure turbine 8.

Conventionally, after having traversed the fan, the air is divided into a central primary stream 12*a* and a secondary stream 12*b* which surrounds the primary stream. Primary stream 12*a* flows in a main airstream 14*a* containing the gases traversing compressors 4, 6, combustion chamber 11 and turbines 7, 8. Secondary stream 12*b*, for its part, flows in a secondary airstream 14*b* delimited radially on the outside by an engine housing, surrounded by a nacelle 9.

Conventionally, in low-pressure turbine 8 rotor disks and distributors alternate with one another. A rotor disk includes a disk and a plurality of blades 18 supported by the disk, distributed circumferentially around the disk.

Figure 2:
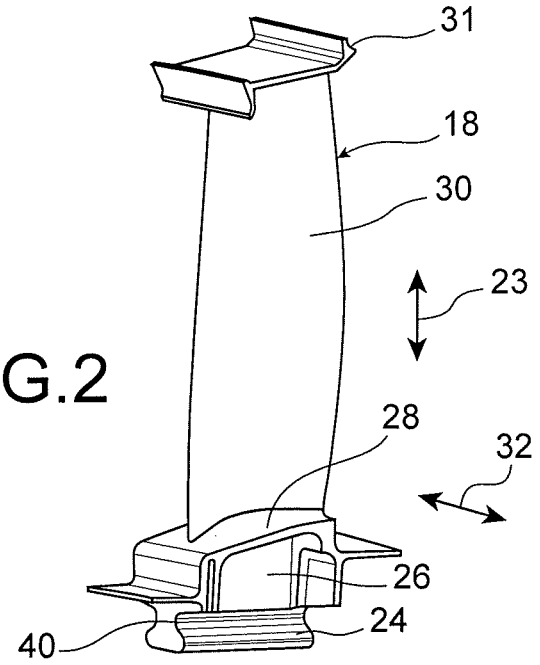

FIG. 2 represents a perspective view of an example of a blade 18 of a rotor disk of a low-pressure turbine 8 of turbofan 1 of FIG. 1.

Blade 18 includes, in a radial direction 23 relative to central axis 2, from inside to outside, a blade foot root 24, a neck 40, a support 26, a platform 28, a rotor vane 30 comprising the aerodynamic portion of the blade, and a tip 31. Root 24, neck 40 and support 26 form the blade foot.

The outside shape of blade foot root 24 is "fir tree" or "bulbous", allowing it to be inserted into a blade insertion groove made in the turbine disk. Support 26 is habitually thin in a circumferential direction 32, while platform 28 extends either side of support 26 in this same circumferential direction 32.

Figure 3A:
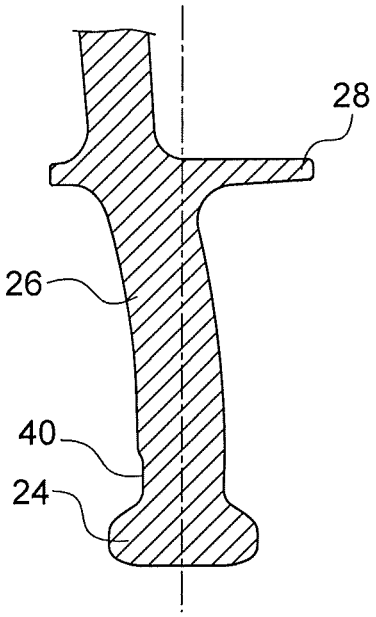
Figure 3B:
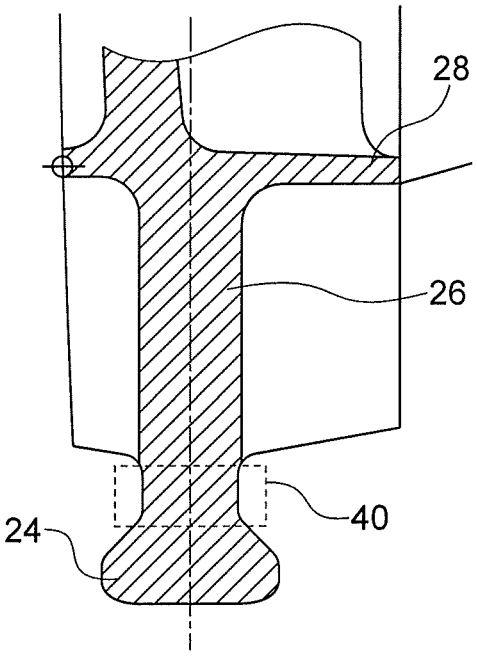

In the example of FIG. 2, rotor blade 18 contains a straight support 26, which is also illustrated by FIG. 3B. FIG. 3B also illustrates the presence of neck 40 between root 24 and support 26.

However, certain rotor blades 18 have supports 26 of curvilinear shape, also called "progressive", as illustrated by FIG. 3A, which results in better overlap between rotor vane 30 and support 26, and also enables metal cooling continuity to be improved, in order in particular to prevent the formation of a discontinuity between the grains in monocrystalline metals or oriented or columnar polycrystals.

However, even if support 26 of such a rotor blade 18 has a curvilinear shape, the connection of rotor blade 18 with the turbine disk is made by means of a root 24 of rectilinear shape, as can be seen in FIG. 2, in other words having a parallelogram-shaped section in a plane perpendicular to radial direction 23.

The centrifugal forces relating to the rotational movement of the turbine disk create a concentration of stresses in neck 40 of the blade foot. Since neck 40 is machined at the same time as the rectilinear blade foot the section of neck 40 is parallelogram-shaped.

Figure 4:
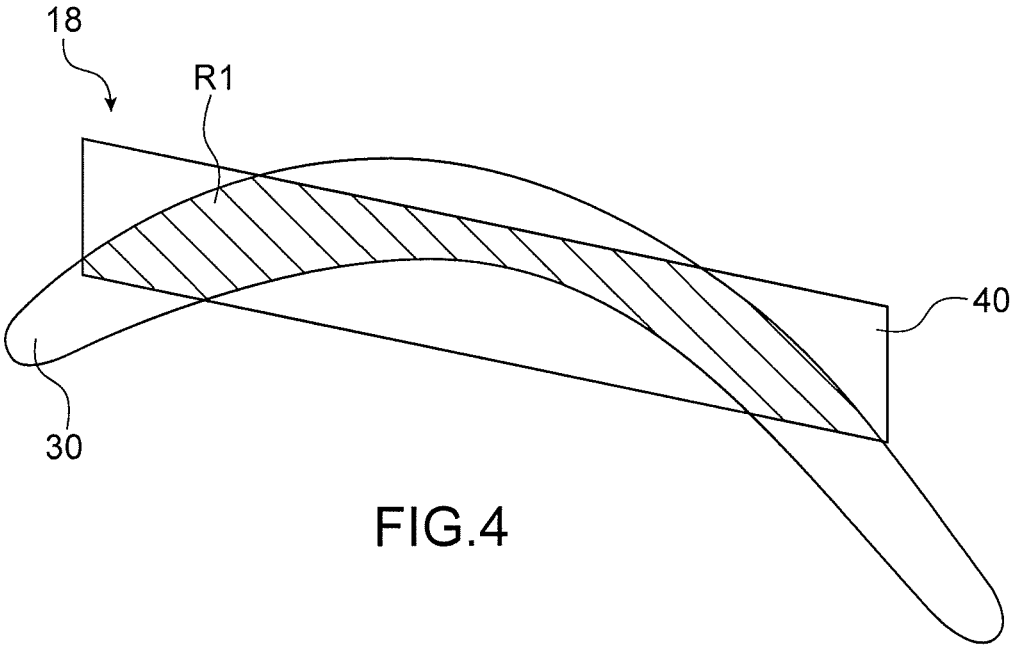

FIG. 4 partially illustrates, seen from a top view, overlap R1 of the section in the foot of rotor vane 30 by neck 40 of the blade foot, in the form of a parallelogram, for rotor blade 18 of FIG. 2. In this FIG. 4 only neck 40 and rotor vane 30 are therefore represented in section, and their overlap R1 is shown by hatching.

It can be seen that overlap R1 is not satisfactory. Rotor vane 30 is far from fully overlapped by the section of neck 40. The field of distribution of the stresses on the section of neck 40 is consequently not uniform.

There is therefore a requirement to improve the design of turbine rotor blades, and in particular a need to restrict the areas of high stress concentrations in such blades.

DESCRIPTION OF THE INVENTION

The aim of the invention is therefore to provide an at least partial solution to the requirements mentioned above, and to the disadvantages compared to the embodiments of the prior art.

The object of the invention is therefore, according to one of its aspects, a rotor blade for a rotor disk of a turbine of an aeronautical turbomachine including, from the interior to the exterior, a blade foot root, a support, a platform and a rotor vane, where the root is connected to the support by a neck, characterised by the fact that the neck, and in particular the foot of the rotor blade including the root, the neck and the support, has a curvilinear profile defining, in a section in a plane perpendicular to the radial direction, a dished shape, extending in particular in a curvilinear axis, and by the fact that the said neck section thus overlaps at least 75%, and in particular at least 80%, of the section of the rotor vane, as a projection of the sections of the neck and of the rotor vane in a plane perpendicular to the radial direction, in the area where the section of the rotor vane joins the platform.

By virtue of the invention it can be possible to optimise the distribution of the stresses in the neck of a turbine rotor blade, which positively impacts the lifetime of the part. The invention can also allow an improved alignment of the blade's rotor vane on its foot, which facilitates continuity of the grains of the foot in the rotor vane for oriented or columnar polycrystals, and limits the formation of parasitical grains on single crystals.

The turbine rotor blade according to the invention can also include one or more of the following characteristics, considered in isolation or in all possible technical combinations.

Preferentially, the platform is roughly curvilinear in order to enable the blade to be installed.

Preferentially, the neck and the rotor vane can have a curved shape, with the same alignment.

The curvilinear axis of the neck can define an arc of a circle.

The curvilinear profile of the neck can, more specifically, define, in a section in a plane perpendicular to the radial direction, a parallelogram shape which is curved in the curvilinear axis.

The curvilinear axis can advantageously include a first portion of an axis configured to extend roughly parallel to the rotational axis of the turbine rotor blade, by this means defining an angle which is appreciably zero between the said first portion of the axis and the rotational axis. The said first portion of the axis can be configured to be located in the area of the upstream portion of the neck.

The curvilinear axis can also advantageously also include a second portion of an axis, configured to extend at an angle of less than or equal to 45° relative to the rotational axis of the turbine rotor blade. The said second portion of the axis can be configured to be located in the area of the portion downstream from the neck.

Another object of the invention is, according to another of its aspects, a turbine rotor blade for an aeronautical turbine, characterised by the fact that it includes a turbine disk and a plurality of rotor blades as defined above, supported by the disk and distributed circumferentially around the disk.

Another object of the invention is, according to another of its aspects, a turbine for an aeronautical turbine, characterised by the fact that it includes at least one rotor disk as defined above, where the turbine is preferentially a low-pressure turbine.

Another object of the invention is, according to another of its aspects, an aeronautical turbine, characterised by the fact that it includes at least one turbine as defined above, where the turbomachine is preferentially a twin-body turbomachine.

The rotor blade, the rotor disk, the turbine and the aeronautical turbomachine according to the invention can include any one of the characteristics stated in the description, considered in isolation, or in all technically possible combinations with other characteristics.

BRIEF DESCRIPTION OF THE ILLUSTRATIONS

Figure 5:
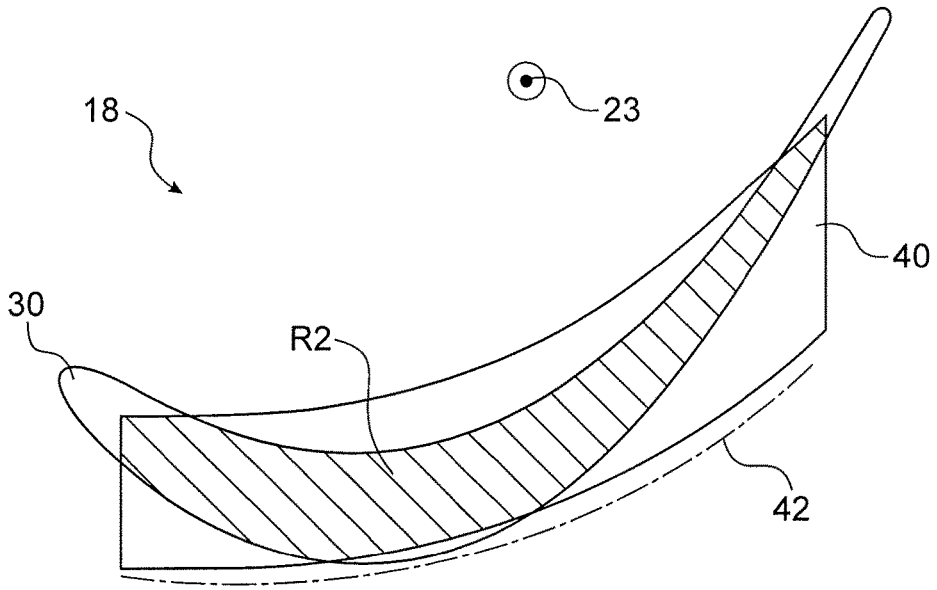
Figure 6:
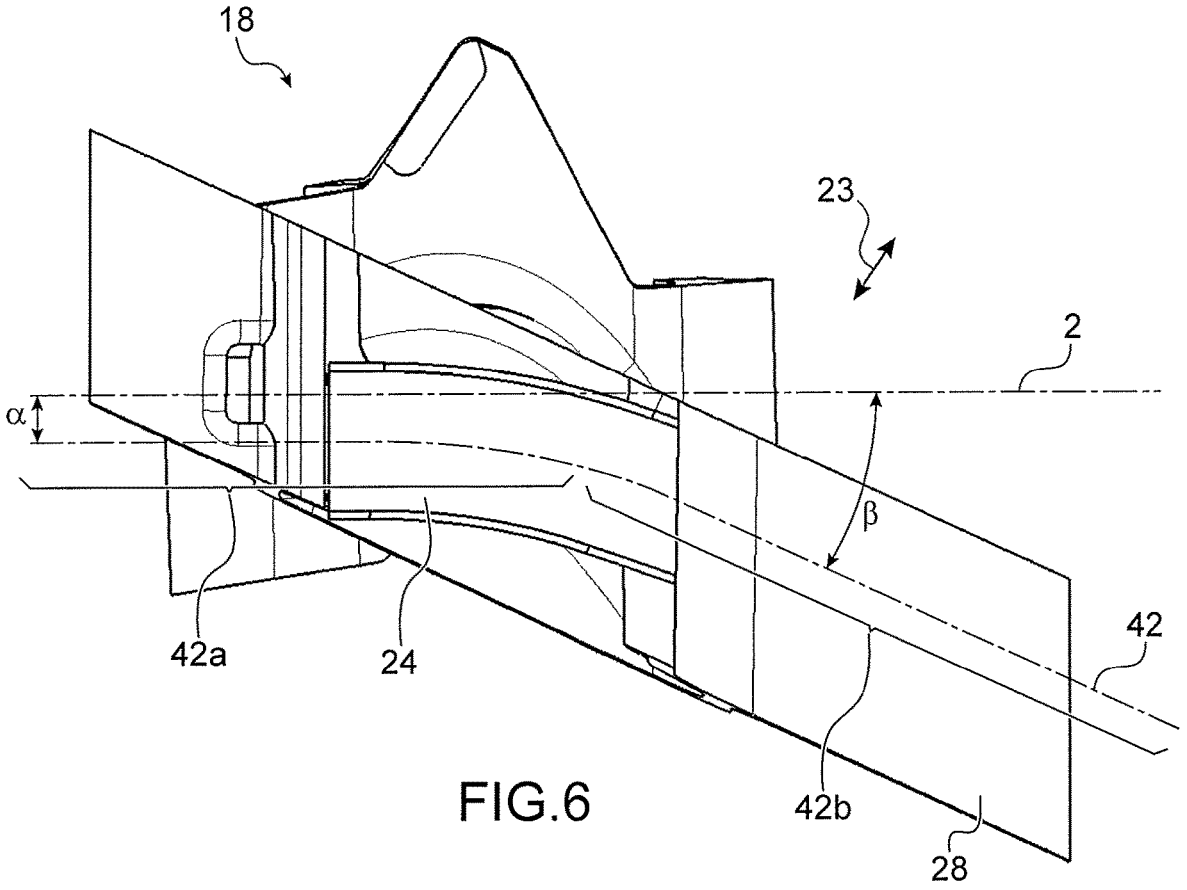

The invention will be able to be better understood on reading the detailed description, below, of a non-restrictive example implementation of it, and also on examining the figures, which are schematic and partial, of the appended illustration, in which:

FIG. 1 is a diagrammatic axial section view of an example of a turbofan suitable for implementation of the invention, FIG. 2 gives a perspective view of an example of a turbine disk of the turbofan of FIG. 1, FIGS. 3A and 3B illustrate, as partial section views, example shapes of supports of turbine disk blade foots, respectively a progressive support and a straight support, FIG. 4 partially illustrates, seen from a top view, the overlap of the section in the foot of the rotor vane by the neck of the foot for a turbine disk blade such as that of FIG. 2, FIG. 5 partially illustrates, seen from a top view, the overlap of the section in the foot of the rotor vane by the curvilinear neck of the foot for a turbine disk blade in accordance with the invention, and FIG. 6 partially represents, seen from a view from beneath, a low-pressure turbine rotor blade in accordance with the invention, such as that associated with FIG. 5.

In all these figures, identical references can refer to identical or comparable elements.

In addition, the various portions represented in the figures are not necessarily represented at a uniform scale, in order to make the figures more readable.

DETAILED ACCOUNT OF A PARTICULAR EMBODIMENT

In the entire description it should be noted that axis 2 of turbomachine 1 is called its axis of radial symmetry (see FIG. 1). The axial direction of turbomachine 1 is the same as rotational axis 2 of turbomachine 1. A radial direction of turbomachine 1 is a direction perpendicular to axis 2 of turbomachine 1. In addition, unless otherwise stipulated, the adjectives and adverbs axial, radial, axially and radially are used in reference to the above-mentioned axial and radial directions, and the terms interior (or internal) and exterior (or external) are used in reference to a radial direction, such that the internal portion of an element is closer to axis 2 of turbomachine 1 than the external portion of the same element.

FIGS. 1 to 4 have been described above in the part relating to the state of the prior art and to the invention's technical context.

FIG. 5 partially illustrates, seen from a top view, the overlap of the section in the foot of rotor vane 30 by curvilinear neck 40 of the foot for a rotor disk blade 18 of turbine 8 in accordance with the invention, and FIG. 6 partially represents, seen from a view from beneath, a rotor blade 18 of a low-pressure turbine 8 in accordance with the invention associated with FIG. 5.

The invention advantageously enables the section of neck 40 of the blade foot to be optimised in order that its overlap R2 with the section of rotor vane 30 in the foot is as effective as possible.

In particular, as can be seen in FIG. 5, neck 40 has a curvilinear profile which defines, in a section in a plane perpendicular to radial direction 23, a curved shape extending in a curvilinear axis 42.

This section of neck 40 advantageously overlaps at least 75% of the section of rotor vane 30, as a projection of the sections of neck 40 and of rotor vane 30 in a plane perpendicular to radial direction 23, where it joins platform 28. In this example of FIG. 5, overlap R2, symbolised by hatching, is even greater than 80% of the section of rotor vane 30 in the foot. It should be noted that platform 28 is roughly curvilinear, to enable the blade to be installed.

Advantageously, by this means the field of stresses is better distributed over the surface of neck 40. In addition, this improved alignment facilitates the growth of grains in rotor vane 30, and a reduction of the stress concentrations due to the geometrical accidents.

More specifically, neck 40 and blade foot root 24 are in this case machined to be curvilinear, in order to have the shape of an arc of a circle, using the same alignment as that of rotor vane 30.

To facilitate installation of the parts curvilinear axis 42 includes a first portion of axis 42*a* configured to extend roughly parallel to rotational axis 2 of the turbine rotor disk, and a second portion of axis 42*b* forming a non-zero angle with rotational axis 2.

More specifically, input angle $\alpha$, which can be seen in FIG. 6, on the upstream side of blade foot root 24, is chosen such that it is roughly zero relative to engine axis 2. In the same way, also to facilitate installation, output angle $\beta$, which is located on the downstream side of root 24, formed between the second portion of axis 42*b* and engine axis 2, is chosen such that it is less than or equal to 45°.

The invention is, of course, not limited to the example embodiment which has just been described. Various modifications may be made to it by those skilled in the art.

The invention claimed is:

1. A rotor blade for a rotor disk of a turbine of a turbomachine comprising, in a radial direction from inside to outside:

a blade foot root;

a support;

a platform; and a rotor vane, wherein the root is connected to the support by a neck, wherein the neck has a curvilinear profile defining, in a section in a plane perpendicular to the radial direction, a dished shape, wherein a section of the neck overlaps at least 75% of a section of the rotor vane, as a projection of the sections of the neck and of the rotor vane in a plane perpendicular to the radial direction, in an area where the section of the rotor vane joins the platform, and wherein, in the projection of the sections of the neck and of the rotor vane in the plane perpendicular to the radial direction in the area where the section of the rotor vane joins the platform, a leading edge of the rotor vane is further upstream than an upstream end of the neck in an axial direction and a trailing edge of the rotor vane is further downstream of a downstream end of the neck in the axial direction.

2. The rotor blade according to claim 1, wherein the foot of the rotor blade, including the root, the neck and the support, has a curvilinear profile defining, as the section in the plane perpendicular to the radial direction, a curved shape.

3. The rotor blade according to claim 1, wherein the neck and the rotor vane have a curved shape, with a same alignment.

4. The rotor blade according to claim 1, wherein the curvilinear profile of the neck defines, in the section in the plane perpendicular to the radial direction, a parallelogram shape which is curved in a curvilinear axis.

5. The rotor blade according to claim 4, wherein the curvilinear axis includes a first portion configured to extend parallel to a rotational axis of the turbine rotor blade, defining an angle which is zero between the first portion of the curvilinear axis and the rotational axis, where the first portion of the curvilinear axis is configured to be located in an upstream part of the neck.

6. The rotor blade according to claim 5, wherein the curvilinear axis includes a second portion configured to extend at a non-zero angle of less than or equal to 45° relative to the rotational axis of the turbine rotor blade.

7. The rotor blade according to claim 6, wherein the second portion of the curvilinear axis is configured to be located downstream from the first portion of the curvilinear axis.

8. A rotor disk for a turbomachine, comprising:

a turbine disk; and a plurality of rotor blades according to claim 1, supported by the turbine disk and distributed circumferentially around the turbine disk.

9. A turbine for a turbomachine, including at least one rotor disk according to claim 8.

10. A turbomachine, including a turbine according to claim 9.

11. The rotor blade according to claim 1, further comprising a tip at a radially outer end of the rotor vane, the tip including a wiper.

* * * * *